United States Patent [19]

Poush et al.

[11] 4,080,279

[45] Mar. 21, 1978

[54] EXPANDABLE ANODE FOR ELECTROLYTIC CHLORINE PRODUCTION CELL

[75] Inventors: Kenneth A. Poush; Otis C. Taylor, both of Lake Jackson, Tex.

[73] Assignee: The Dow Chemical Company, Midland, Mich.

[21] Appl. No.: 722,846

[22] Filed: Sep. 13, 1976

[51] Int. Cl.[2] ..... C25B 9/00; C25B 11/03

[52] U.S. Cl. ..... 204/252; 204/284; 204/288; 204/289

[58] Field of Search ..... 204/284, 288, 286, 289, 204/252

[56] References Cited

U.S. PATENT DOCUMENTS

| | | | |
|---|---|---|---|
| 3,674,676 | 7/1972 | Fogelman | 204/288 X |
| 3,873,437 | 3/1975 | Pulver | 204/288 X |
| 3,941,676 | 3/1976 | Macken | 204/288 X |
| 4,032,423 | 6/1977 | Cunningham | 204/289 X |

*Primary Examiner*—John H. Mack
*Assistant Examiner*—D. R. Valentine
*Attorney, Agent, or Firm*—Melvin William Barrow

[57] ABSTRACT

An electrolytic cell expandable anode assembly particularly useful as anodes in commercial chlor-alkali productions cells, said assembly having two parallel, foraminous working faces and a simple spreading means. This spreading means plays no role in the conduction of electricity from any external power source to the working faces. Rather, said electrical conduction role is performed by an intermediate, stationary conducting means connecting the working faces at one of these ends which also physically holds the anodes in place within the cell by rigidly connecting them to one end of each of the working faces and rigidly connected then to the anode base of said anode assembly.

9 Claims, 12 Drawing Figures

EXPANDABLE ANODE FOR ELECTROLYTIC CHLORINE PRODUCTION CELL

BACKGROUND OF THE INVENTION

The use of electrolytic cells in the commercial production of chemicals by electrolysis is old in the art.

Particularly is this true in the production of chlorine, caustic, and hydrogen by the electrolysis of aqueous solutions of sodium chloride. Electrolytic cells for this purpose generally have a multiplicity of cathodes and anodes generally arrayed in a alternate, parallel fashion within the cell. Diaphragm Chlor-Alkali electrolytic cells nearly always have the diaphragm disposed between each anode and cathode. Most often the diaphragm is deposited on the external surface of the cathodes. The cathodes are usually shaped so as to form a hollow chamber within the working faces of the cathodes. The working faces are foraminous surfaces to allow passage of the fluid electrolyte from the anode compartments through the diaphragms and through the foraminous cathode working faces into the interior of the cathodes. In most chlorine cells the anodes have long been made of graphite usually having the shape of solid rectangular prisms.

During the assembly of such cell as described above, much damage is often done to the diaphragms by their being scraped by the anodes as the anodes are slid past the diaphragms into their operational position interleaved between the cathodes. To minimize this damage these graphite anodes have to be designed with a smaller thickness than is desired for optimum cell operating efficiency. However, insofar as electrical energy power lost is concerned during cell operation, the thickness of these graphite anodes should be capable of being enlarged in order to minimize the distance between the opposing anode and cathode working faces; i.e., to reduce the electrical resistance path. This distance is referred to as the anode-cathode gap. Thus in the use of anodes whose thickness could not be varied, such as with the graphite anodes, there has existed a trade-off in the thickness design of the anodes, this trade-off being occasioned by the competing considerations of having a thicker anode to reduce the anode cathode gap to effect electrical power savings against the consideration of having a more narrow anode to have a wide anode-cathode gap to reduce the risk of diaphragm damage during cell assembly.

One anode assembly has recently been designed to overcome this anode-cathode gap width trade-off. It is an anode assembly which can be caused to have a large anode-cathode gap during cell assembly by reducing the overall thickness of this anode assembly, but yet one having the capability of reducing the anode-cathode gap during cell operation by expanding the overall thickness of the anode. This expandable anode assembly is disclosed in U.S. Pat. No. 3,674,676 (Fogelman July 4, 1972). It was made possible by the breakthrough in chlor-alkali anode design of replacing the solid graphite electrodes with the so-called dimensionally stable anodes.

These dimensionally stable anodes are thin anode sheets of metals such as titanium, tungsten and tantalum. These dimensionally stable anodes have a much higher coefficient of electrical conductivity than do the graphite anodes. At the same time they withstand the corrosive attack of the hostile environment surrounding the anodes in chlorine cells; i.e., an aqueous mixture of brine, hydrochloric acid, and chlorine gas as does the graphite.

In serving as an improved replacement for the graphite anodes, the above identified expandable anode assemblies utilize several parts. Further, all of these parts must be electrically connected. The electrical conductivity of each anode part requires each of the several parts to be made from the same or similar, expensive, electrically conducting (but non-corrosive) metals as are the anode working faces. Furthermore, when dealing with the special metal there is required a high degree of skill as well as special equipment to make the several necessary welded connections. This increases manufacturing costs to prohibitive amounts when manufacturing such anodes for commercial use. This difficulty in assembly, the relatively large number of parts required, and the expense of materials is significantly reduced by the present invention.

SUMMARY OF THE INVENTION

The present invention is an expandable anode assembly comprising:

a. an anode base, b. a pair of substantially flat electrode working faces disposed side by side in a substantially parallel fashion said faces being resilient, with a spring memory directed toward one another so that when the cell is assembled said faces are near together (hereinafter, also referred to as a collapsed position);

c. an intermediate electrical and physical connecting means, one part of which is rigidly attached to the ends of the working faces near the anode base, and the other part of which is rigidly attached to, and extends through, the anode base to physically hold the working faces in place with respect to said base, and simultaneously furnish an electrical conducting path from an electrical power source external to the cell to the working faces within the cell; and d. at least one spreading means which when inserted and frictionally mounted between the anode working faces, spreads said working faces from the collapsed position to an "expanded position."

The expanded position of the working faces is the position the anode working faces are in when they are positioned as close as is desired to their corresponding cathode working faces.

The working face spreading means may be permanently affixed within the working faces, or it may be detached and inserted between the working faces for their spreading, following cell assembly. The spreading means may be electrically non-conductive or conductive, inasmuch as it does not play a role in the conduction of electricity to the working faces. There is no reason for using it as an electrical conduction. Hence it may be made from any inexpensive material which is non-corrosive in the aqueous mixture of brine, HCl, and $Cl_2$ gas found in the anode compartment of a chlorine cell. Most any rigid, chemically stable material is satisfactory for making these spreading means, e.g., rigid plastics, woods, glass, etc.

The anode base is electrically conductive so that the working faces can receive their electrical power directly from the base. The base receives its electrical power from a D.C. power source external to the cell by the intermediate electrical and physical connecting means.

DETAILED DESCRIPTION OF THE INVENTION

Figure 1B:
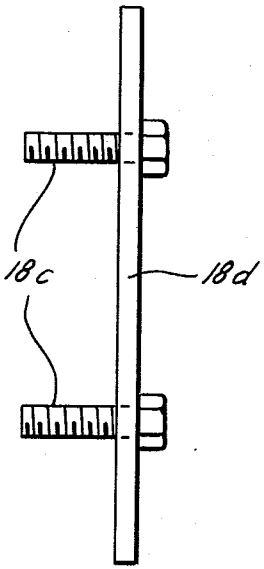
FIG. 1*a* and FIG. 1*b* are side elevational views of particular embodiments of the intermediate electrical and physical connecting means.
Figure 1A:
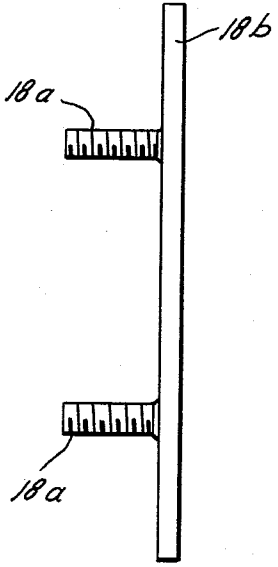
Figure 1:
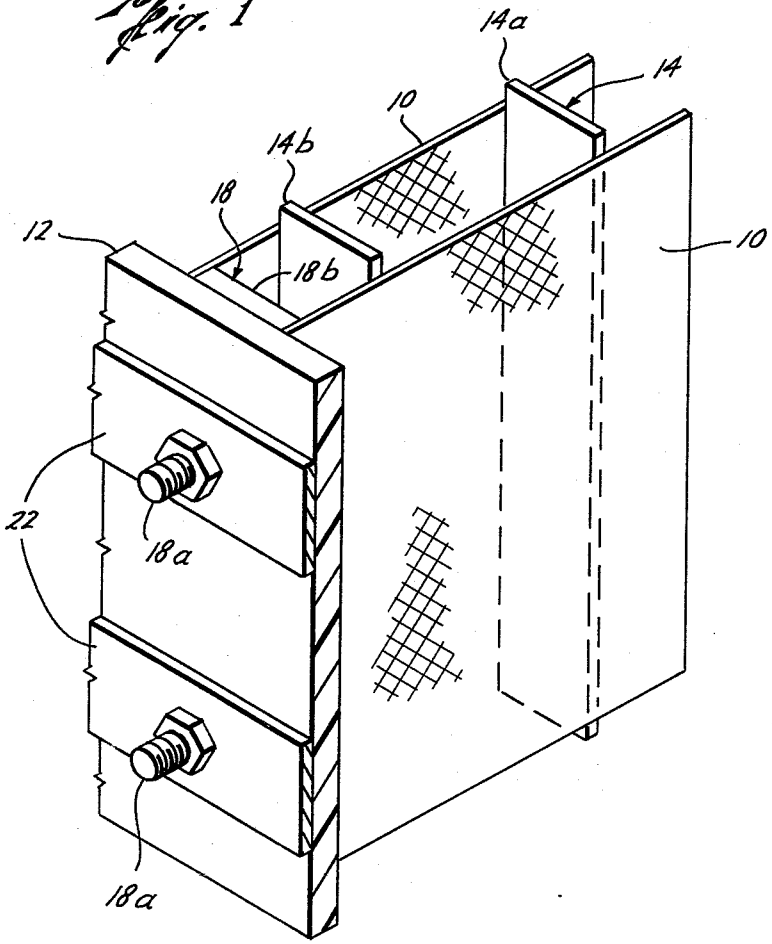
FIG. 1 is a perspective view of the anode assembly of the present invention with the anode base 12 shown broken away from its remainder.

Referring to FIG. 1, the anode assembly of the present invention can be seen. The anode working faces 10 have been spread apart by two spreading bars, 14*a* and 14*b*. The working faces 10 are physically and electrically connected to an intermediate electrical conducting means 18 by means such as welding.

One embodiment of the intermediate electrical connecting means 18 is shown in FIG. 1*a*. Studs 18*a* are attached to the metal bar 18*b* by welding. An alternative embodiment an alternate embodiment of means 18 having bolts 18*c* extend through holes in the bar 18*d*. The parts of the intermediate electrical connecting means 18 extending through the electrode base 12, such as the studs 18*a*, can easily be connected to a variety of known external D.C. electric power connecting means 22, external to the cell, such as copper or aluminum bus bars.

Figure 2:
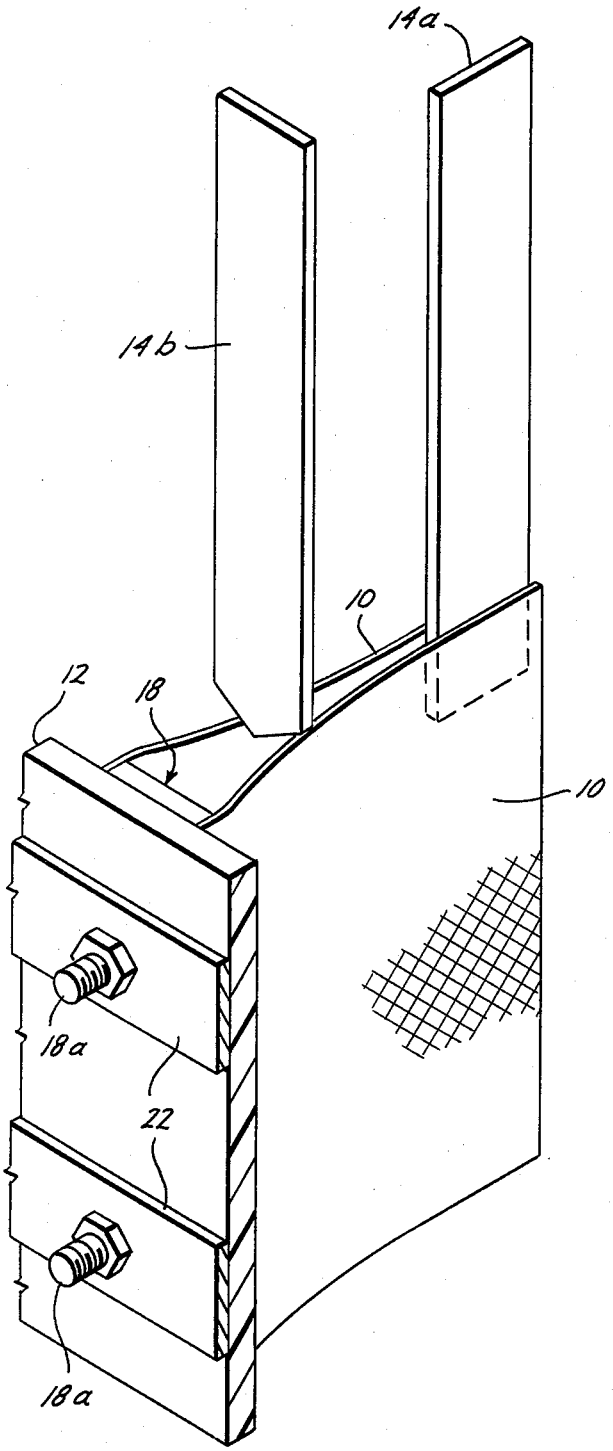
FIG. 2 is a perspective view of the anode assembly shown with electrode working faces 10 in their collapsed positions, with spreading bar 14*a* and tapered spreading bar 14*b* just ready to be inserted for spreading said collapsed working faces 10.

In FIG. 2 the anode working faces 10 are shown in their collapsed position and the spreading means 14*a* and 14*b* are shown just before they are inserted between the working faces 10. Working faces 10 are seen to be close together before the spreading means 14 (14*a* and 14*b* in FIG. 2) are positioned in place. This is due to the resilience of the diminsionally stable metals needed to be used for the construction of these working faces, and the fact that these are originally constructed with a spring memory which causes them to tend to remain or return to this collapsed position, close to one another. Their position, when the spreading means 14 has spread them apart from this collapsed position, is referred to as their "expanded position" or "spread position".

The spreading means 14 can be constructed from a variety of materials. Electrically conductivity of these materials, unlike the prior art, is of no consequence in this assembly inasmuch as the spreading means plays no part in the conduction of electricity to the working faces 10 from the external D.C. power connecting means 22. The only limitation on the type of material used is that it be rigid enough to force and maintain the working faces 10 apart. Also these materials must be made of materials which can withstand attack of the environment of the type electrolytic cells in which it is used. Thus when used as an anode in a chlor-alkali cell, the spreading means must be able to withstand the chemically corrosive attack of an aqueous mixture of brine, hydrochloric acid and chlorine gas. Many materials such as glass, wood, many plastics, and some metals meet these criteria for chlor-alkali electrolytic cells.

Figure 3:
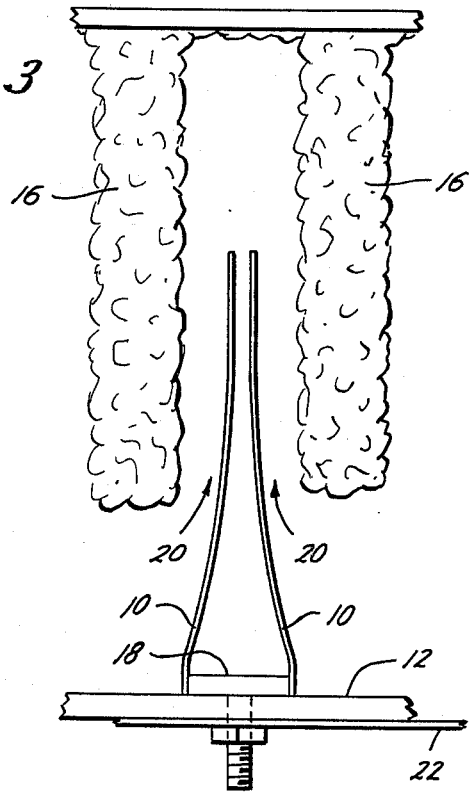
FIG. 3 is a top view of the anode assembly of FIG. 2 without the spreading bars 14*a* and 14*b*, drawn to illustrate the wide anode-cathode gap 20 existing between the anode working faces 10 and the diaphragm-coated cathodes 16 (not shown in FIG. 2), of a chlorine cell when the anode working faces 10 are in their collapsed position during the step of cell assembly in which they are inserted between said diaphragm-coated cathodes.
Figure 4:
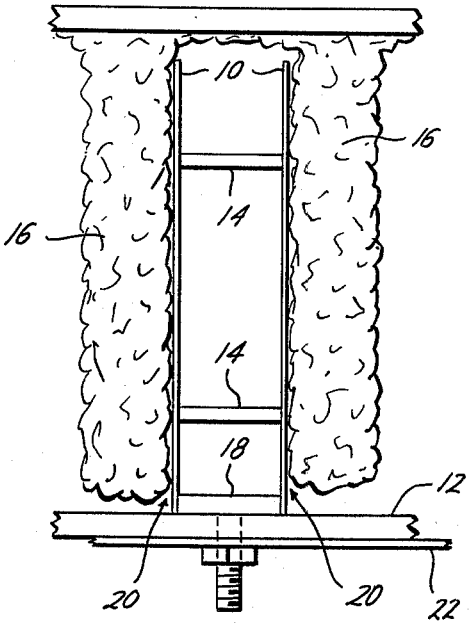
FIG. 4 is a top view of the anode assembly and diaphragm-coated cathodes of FIG. 3 with the anode working faces 10 spread from their collapsed position, by two of the spreading bars 14 of the anode assembly, as close to the surfaces of the diaphragm-coated cathodes 16 as is desirable, for chlorine cell operation.

Although the spreading means 14 can be fixedly attached to the working faces 10 it is preferred that it not be so. When not fixedly attached to said working faces 10, the spreading means 14 may be inserted and positioned between the working faces 10 in at least two ways. It may be slipped in "edgeways" between the working faces as the spreadng means 14*a* of FIG. 2 depicts. ("Edgeways" here means having the face of the spreading means 14 parallel to the sides of the working faces 10). Following this "slipping in edgeways" of the spreading means 14, said spreading means can be rotated until its edges have caused the working faces 10 to be spread apart the desired amount. This desired amount is directly proportional to the smallness of the anode-cathode gap 20 desired. This anode-cathode gap 20 is illustrated in FIG. 3 and FIG. 4.

Another method for inserting the spreading means 14 is to force it "sidewise" between the anode working faces 10. That is, having the face of the spreading means 14 perpendicular to the working faces 10 at the beginning, and during the insertion of, said spreading means 14. In order to insert the spreading means 14 sidewise between the working faces 10, the entering side of the spreading means 14 should be tapered; e.g., the wedge-shaped bottom side of spreading bar 14*b* of FIG. 2, or the rounded bottom side of the spreading bar 14*d* of FIG. 7.

No matter what method of insertion of the spreading means 14 is used, once the spreading means 14 has spread the anode working faces 10, it is held in place by the frictional forces exerted on its edges by the resilient anode working faces 10 with their spring memory directed inward against the spreading means 14. This method of maintaining the unfixed or detachable spreading means by friction between the spreading means 14 and working faces 14 will be referred to as "frictionally mounting" the spreading means between the working faces 10.

It should also be pointed out that although two spreading means are shown in each of the drawings, only one is required. Use of more than one gives more uniformity to anode-cathode gap width 20. In long working faces 10, more than one spreading means 14 is highly desirable.

Figure 5:
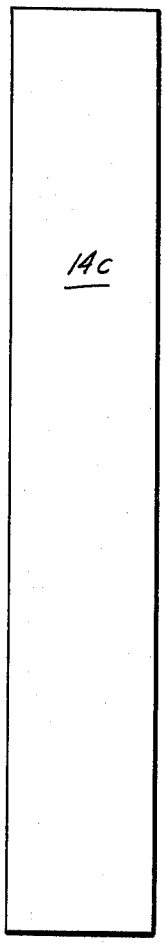
FIG. 5 is a front elevation of another embodiment 14*c* of the spreading means for the electrode assembly.

Various shapes and features for some different embodiments of the spreading means 14 are shown in FIGS. 5–10. The embodiment of a spreading means 14 in FIG. 5 is simply a thin rectangular prism 14*c*.

Figure 6:
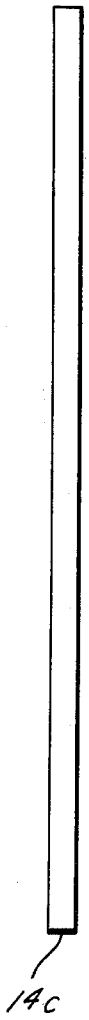
FIG. 6 is a side elevation of the spreading means 14*c* of FIG. 5.

FIG. 6 is merely a side view of the front view of the embodiment of the spreading means 14c of FIG. 5.

Figure 7:
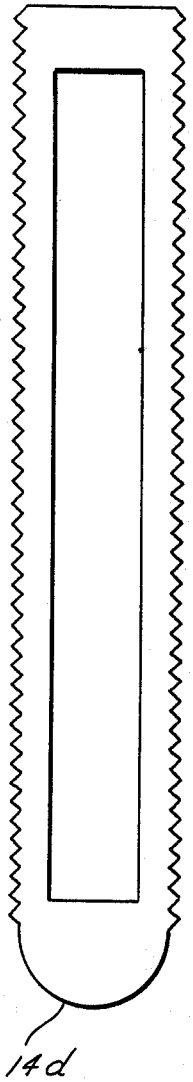
FIG. 7 is a front elevation of another embodiment 14*d* of a spreading means of the electrode assembly showing optional features adaptable to the spreading means.

The embodiment 14c of a spreading means 14 in FIG. 7 has the same overall rectangular prism shape of the embodiment in FIG. 5 and FIG. 6. It has additional features such as serrated edges 26, a large opening 24 through its center, and a rounded bottom 28. Any of these features can be omitted. The serrated edges 26 can aid in holding the frictionally mounted spreading means in place when anode working faces 10 of foraminous material such as expanded metal or mesh is used as the anode working faces 10 by having the points of the serrated edges 26 engage the interstices of the foraminous material. The opening 24 is useful in allowing better circulation of the electrolyte within the anode working faces 10. The rounded bottom 28 aids in insertion of the working means between the collapsed working faces 10.

Figure 8:
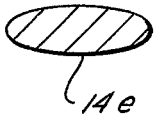
FIGS. 8, 9, and 10 are cross sectional end views of other embodimens 14*c*, 14*f*, 14*g* of spreading means suitable for this invention.
Figure 9:
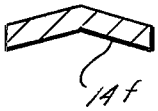
Figure 10:
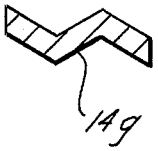

FIG. 8 is a cross-section of an embodiment of a spreading means 14e having an oval cross-sectional shape. FIG. 9 shows a cross-section of an embodiment 14f that has an annular cross-sectional shape an angle. FIG. 10 shows a cross-section of an embodiment 14g that has a "zig-zag" shape. Many other shapes for spreading means 14 can easily be built which would accomplish the same result. For example a pointed pencil shaped object could easily be used as a spreading means 14 which is forced between the resilient working faces 10 to spread them apart. The only limitation on the shape of the spreading means is (1) that it have parallel those of its sides which contact the anode working faces 10 in their spread (or expanded) position, and (2) the length should be sufficiently long to substantially transverse the working faces 10 from top to bottom. In those embodiments of a spreading means which are inserted "edgewise" and then rotated to spread the working faces 10 apart, an additional shape limitation is imposed. Its thickness at its bottom should be substantially no greater than the space between the collapsed working faces 10. For example in FIG. 2, the thickness of the embodiment 14a should be no greater than the distance between the anode working faces 10.

Regarding the width of the anode-cathode gap 20, FIG. 3 and FIG. 4 illustrate the extremes of this gap width. In FIG. 3 the anode working faces 10 are shown as they are about half-way inserted between the adjacent diaphragm-coated cathodes 16 during that part of the assembly of the cell when the working faces are slid between the diaphragm-coated cathodes 16 and where the width of the anode-cathode gap 20 is desired to be as large as possible to prevent scraping the diaphragms by the anode working face 10. In FIG. 4 the cell assembly step of sliding the anode working faces 10 between the diaphragm-coated cathodes 16 has been completed, and the spreading means 14 has spread the anode working faces for enough apart so that they are actually pressing against the corresponding working faces of the diaphragm-coated cathodes 16. Hence the anode-cathode gap 20 is reduced, in this instance, substantially to the mere width of the diaphragm separating the corresponding anode and cathode working faces. The width of the diaphragm is the ideal anode-cathode gap width desired for the operation of a chlor-alkali cell. However, it should be pointed out that the with of the anode-cathode gap 20 is continuously variable. That is the spreading means 14 can be adjusted so that the anode cathode gap has any width from the broad width it has when the working faces are collapsed, as they are in FIG. 2 and FIG. 3, to the very narrow width it has when the anode working faces are spread until they are contacting the diaphragms of the corresponding diaphragm-coated cathodes 16.

The working faces 10 of the electrode assembly must, of course, be electrically conductive, resilient with a spring memory inward toward each other, foraminous to allow the passage of electrolyte therethrough, and resistive to the corrosive attack of its environment.

Generally the working faces 10 are made foraminous by "expanding" them (in the expanded metal sense) or punching holes in sheets of suitable metals such as titanium, tungsten, and tantalum.

The intermediate electrical connecting means must be electrically conductive and that part of it which is exposed to the environment of the cell electrolyte must be resistant against chemical attack, e.g., the bar labelled 18b in FIG. 1a. For chlor-alkali cells such materials as titanium, tungsten, tantalum can be used in making the intermediate electrical connecting means for anode assemblies.

I claim:

1. An expandable anode assembly for use in an electrolytic cell comprising:

a. an anode base, b. a pair of substantially flat anode working faces disposed side by side in a substantially parallel fashion, said faces being resilient, with a spring memory directed toward one another so that when the cell is assembled said faces will be close together, in a collapsed position;

c. an intermediate electrical and physical connecting means having two parts, one part of which is rigidly attached to corresponding ends of the working faces near the anode base, and the other part of which is rigidly attached to, and extends through, the anode base to physically hold the working faces in place and simultaneously furnish an electrical conducting path from an electrical power source external to the cell to the working faces within the cell; and d. at least one detachable spreading means inserted and frictionally mounted between the working faces, spreading said working face from the collapsed position to an expanded position.

2. An anode assembly as described in claim 1 wherein the anode working faces are foraminous.

3. A chlor-alkali cell including an anode assembly as recited in claim 2.

4. An anode assembly as recited in claim 2 wherein the spreading means is so constructed as to be insertable edgeways between the working faces and then rotated between them until they are spread as wide as desired.

5. An anode assembly as described in claim 2 wherein the spreading means is so constructed as to be insertable crosswise by force between the working faces.

6. An anode assembly as recited in claim 2 wherein the anode assembly is used as an anode assembly in a commercial chlor-alkali production cell and the working faces and intermediate electrical and physical connecting means are made from metal which is electrically conductive but dimensionally stable in the anolyte environment of such a cell.

7. An expandable anode assembly for use in an electrolytic cell comprising:

a. an anode base, b. a pair of substantially flat, foraminous anode working faces disposed side by side in a substantially parallel fashion, said faces being resilient, with spring memory directed toward one another so that when the cell is assembled said faces will be close together, in a collapsed position;

c. an intermediate electrical and physical connecting means comprising two parts, (1) one part of which is a bar attached by welding to the ends of the working faces nearest the anode base, and (2) the other part being at least one stud rigidly attached to the bar, said stud extending through and being rigidly attached to the anode base to physically hold the working faces in place and simultaneously furnish an electrical conducting path from an electrical power source, external to the cell, to the working faces within the cell, said anode base having a hole fitted to receive said stud; and d. at least one spreading means inserted and frictionally mounted between the working faces, spreading said working face from the collapsed position to an expanded position.

8. An expandable anode assembly for use in an electrolytic cell comprising:

a. an anode base, b. a pair of substantially flat, foraminous anode working faces disposed side by side in a substantially parallel fashion, said faces being resilient, with a spring memory directed toward one another so that when the cell is assembled said faces will be close together, in a collapsed position;

c. an intermediate electrical and physical connecting means having two parts, one part of which is rigidly attached to corresponding ends of the working faces near the anode base, and the other part of which is rigidly attached to, and extends through, the anode base to physically hold the working faces in place and simultaneously furnish an electrical conducting path from an electrical power source external to the cell to the working faces within the cell; and d. at least one spreading means inserted and frictionally mounted between the working faces, spreading said working face from the collapsed position to an expanded position, said spreading means having serrated edges which contact and engage the interstices of the foraminous working faces.

9. An expandable anode assembly for use in an electrolytic cell comprising:

a. an anode base, b. a pair of substantially flat, foraminous anode working faces disposed side by side in a substantially parallel fashion, said faces being resilient, with a spring memory directed toward one another so that when the cell is assembled said faces will be close together, in a collapsed position;

c. an intermediate electrical and physical connecting means having two parts, one part of which is rigidly attached to corresponding ends of the working faces near the anode base, and the other part of which is rigidly attached to, and extends through, the anode base to physically hold the working faces in place and simultaneously furnish an electrical conducting path from an electrical power source external to the cell to the working faces within the cell; and d. at least one electrically non-conductive spreading means inserted and frictionally mounted between the working faces, spreading said working face from the collapsed position to an expanded position.

* * * * *

UNITED STATES PATENT AND TRADEMARK OFFICE

CERTIFICATE OF CORRECTION

PATENT NO. : 4,080,279
DATED : March 21, 1978
INVENTOR(S) : Kenneth A. Poush et al It is certified that error appears in the above-identified patent and that said Letters Patent are hereby corrected as shown below:

Col. 3, line 36, "embodimens" should be --embodiments--.

Col. 3, line 50, delete "an alternate embodiment".

Col. 3, line 51, "having" should be --had--.

Col. 3, line 51, "extend" should be --extending--.

Col. 3, line 64, "diminsionally" should be --dimensionally--.

Col. 4, line 27, "spreadng" should be --spreading--.

Col. 5, line 56, "for" should be --far--.

Col. 5, line 64, "with" should be --width--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*